US006379525B1

(12) United States Patent
Clements et al.

(10) Patent No.: US 6,379,525 B1
(45) Date of Patent: Apr. 30, 2002

(54) ENHANCED ELECTROLYZER

(75) Inventors: Charles W. Clements, League City; Charles W. Clements, Jr.; Harold Childers, both of Houston, all of TX (US)

(73) Assignee: Exceltec International Corporation, Sugal Land, TX (US)

( * ) Notice: Subject to any disclaimer, the term of this patent is extended or adjusted under 35 U.S.C. 154(b) by 0 days.

(21) Appl. No.: 09/389,527

(22) Filed: Sep. 2, 1999

Related U.S. Application Data

(60) Provisional application No. 60/098,848, filed on Sep. 2, 1998.

(51) Int. Cl.[7] ..... C25B 1/00; C25B 15/08; C25B 1/34

(52) U.S. Cl. ..... 205/334; 205/347; 204/255; 204/257; 204/263

(58) Field of Search ..... 204/232, 254, 204/268, 267, 263, 253, 255, 257, 252; 205/347, 334

(56) References Cited

U.S. PATENT DOCUMENTS 1,476,284 A * 12/1923 Clark ..... 205/147
3,948,750 A * 4/1976 Figueras ..... 204/286
4,305,806 A * 12/1981 Holca ..... 204/268
4,758,322 A * 7/1988 Sioli ..... 204/255
4,783,246 A * 11/1988 Langeland ..... 204/95
5,015,354 A * 5/1991 Nishiki ..... 204/254

FOREIGN PATENT DOCUMENTS

JP 52048596 9/1974
JP 0048596 * 4/1977

* cited by examiner

*Primary Examiner*—Donald R. Valentine
(74) *Attorney, Agent, or Firm*—John G. Flaim

(57) ABSTRACT

An improved electrolyzer is disclosed herein. The electrolyzer includes a housing having an inlet and an outlet at a common end. Within the housing are disposed electrode elements, and a passageway that connects the inlet to the outlet. In accordance with the improvement disclosed and claimed herein, a divider is disposed in the fluid flow passageway between the inlet and outlet. It serves to cause fluid entering the inlet to flow through one section of the passageway, and then through another section of the passageway before exiting through the outlet.

15 Claims, 10 Drawing Sheets

ENHANCED ELECTROLYZER

CLAIM OF PRIORITY

The instant patent application claims priority from the United States provisional application assigned with the Ser. No. 60/098,848, entitled "Divided Electrolyzer Passageway," naming Charles W. Clements, Charles W. Clements, Jr., and Harold Childers as inventors, and which was filed on Sep. 2, 1998.

BACKGROUND

An electrolyzer—sometimes also referred to as an electrolytic generator, bookcell unit, or processing module—is disclosed and claimed in U.S. Pat. No. 4,783,246, issued on Nov. 8, 1988, entitled "Bipolar Rapid Pass Electrolytic Generator," invented by Leonard E. Langeland and Charles W. Clements, and which is incorporated by reference herein for all purposes. In accordance with an embodiment disclosed in that patent, an electrolyzer includes two casing members having inner shallow depressions in which plate-like electrode elements are disposed. A fluid flow passageway, which connects an inlet and outlet, is provided between such electrode elements.

SUMMARY

This patent application discloses an improvement that can be employed in conjunction with an electrolyzer, such as, for example, the electrolyzer disclosed in U.S. Pat. No. 4,783,246.

One improvement provides for the inclusion of a divider in a fluid flow passageway. Division of a passageway into two sections allows for fluid to make at least two passes through a passageway—one pass through one divided section and another pass through the other divided section. By dividing a passageway in accordance with the improvement, the velocity at which fluid will travel through the passageway sections will increase relative to conventional systems.

One or more apertures are thus provided on either side of a divider. Each aperture may be alternated to function as either an inlet for the ingress of fluid or an outlet for the egress of fluid. Accordingly, from time to time, the flow of fluid can be reversed through a given aperture.

Among others, two important advantages are derived from this improvement. First, the improvement allows for more fluid or wastewater (for example, sewage) to be efficiently treated in a given volume relative to conventional systems. This allows for equipment sizing to be less than conventional systems. Second, enhanced cleaning of deposits which form on both anode and cathode electrode elements is achieved by dividing a passageway. Such cleaning is enhanced by flow reversal and the increase in flow velocity between electrode elements. As a consequence, a decrease in the amount of deposits on the electrode elements results. This, in turn, improves the efficiency of the electrode elements. It also serves to significantly reduce or eliminate maintenance related time and costs, as well as extend the life of an electrolyzer.

This improvement may be utilized in numerous different configurations and embodiments. Two exemplary embodiments are described below.

Another improvement disclosed in this application is the use of more than two casing members (such as, for example, three casing members) to form an electrolyzer.

Other improvements are disclosed in this application and provided for in the claims.

DETAILED DESCRIPTION OF EXEMPLARY EMBODIMENTS

This patent application discloses several improvements. Certain of the improvements the electrolyzer disclosed in U.S. Pat. No. 4,783,246. Accordingly, for convenience, a portion of the specification of U.S. Pat. No. 4,783,246 (specifically that portion which relates to FIGS. 1–3) is set forth in the following paragraphs.

Figure 1:
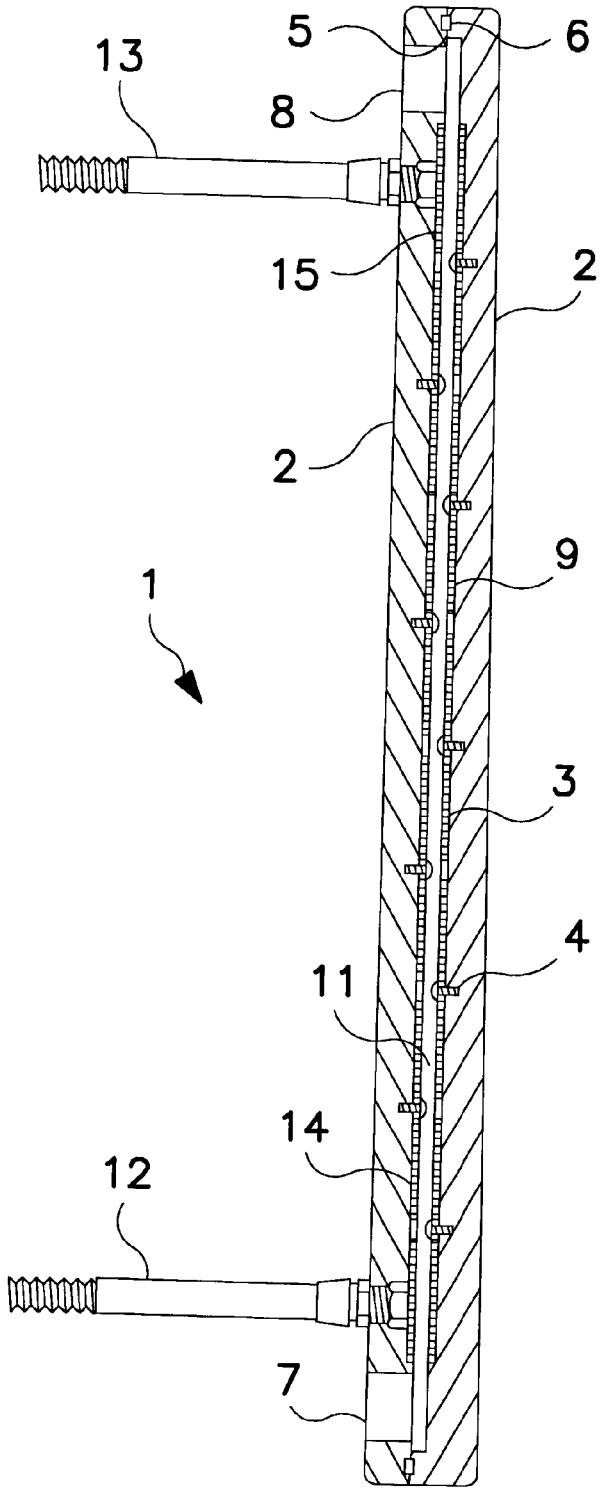
FIG. 1 is a side cross-sectional view of a rapid pass hypochlorite electrolyzer, as set forth in U.S. Pat. No. 4,783,246.

Referring to FIG. 1, there is depicted in side elevational view an electrolyzer 1. Generally, the electrolyzer 1 is formed of two elongated electrically non-conductive casing members 2. These casing members 2 have been brought together, in closed position, to form the electrolyzer 1. Each casing member 2 houses flat, plate-like electrode elements 3 which are fastened to the casing members 2 by means of non-conductive fastening elements 4. One casing member 2 has an outer rim 5. Within this outer rim 5 is a gasket 6 contained in shallow depressions, with these depressions being firstly in the outer rim 5 and secondly in the face of the opposite casing member 2.

In one casing member 2 there is provided a lower fluid inlet 7 and an upper fluid outlet 8. The electrode elements 3, which are inserted and fill shallow depressions on the inner face of the casing members 2, are separated one from the other in each casing member 2 by casing ribs 9. When the pair of casing members 2 are brought together, the outer rim 5 provides for a spacing apart of the electrode elements 3 which face one another, thereby creating a fluid flow passageway 11 between the electrode elements 3.

The casing member 2 containing the lower fluid inlet 7 and upper fluid outlet 8 likewise has a lower anode terminal 12 and an upper cathode terminal 13. These terminals 12,13 are mounted through the wall portion of the casing member 2. For the anode terminal 12, this mounting through the wall connects the terminal to a primary anode plate 14. Across the fluid flow passageway 11 from this primary anode plate 14 is an electrode element 3 which is approximately twice the height of the primary anode plate 14. Thus this opposite electrode element 3 is a bipolar electrode opposite the primary anode plate 14. Similarly, the upper cathode terminal 13 connects with a primary cathode plate 15. This primary cathode plate 15 likewise has, across the fluid flow passageway 11, an electrode element 3 of at least approximately twice the height of the primary cathode plate 15. This opposite, electrode element 3 thus is a bipolar electrode. Other than the primary anode plate 14 and primary cathode plate 15, all electrode elements 3 depicted in FIG. 1 are bipolar electrodes. Also, the facing bipolar electrodes of one casing member 2 are offset in regard to the bipolar electrodes of the opposing casing member 2.

In operation, the lower anode terminal 12 and upper cathode terminal 13 are connected externally to a current supply, not shown. Current is thereby able to flow from the primary anode plate 14 and to the primary cathode plate 15. A brine solution is introduced into the electrolyzer 1 through the lower fluid inlet 7 and passes through the fluid flow passageway 11 between the electrode elements 3. Spent brine solution as well as electrolysis products leave the electrolyzer 1 through the upper fluid outlet 8. Owing to the offset nature of the electrode elements 3 from one casing member 2 to the other, these elements 3 serve as bipolar electrodes and are activated by conductance of the brine solution. A DC current potential applied to the anode and cathode provides a DC current flow in a staggered path through the brine solution from the cathode downward to the anode.

Figure 2:
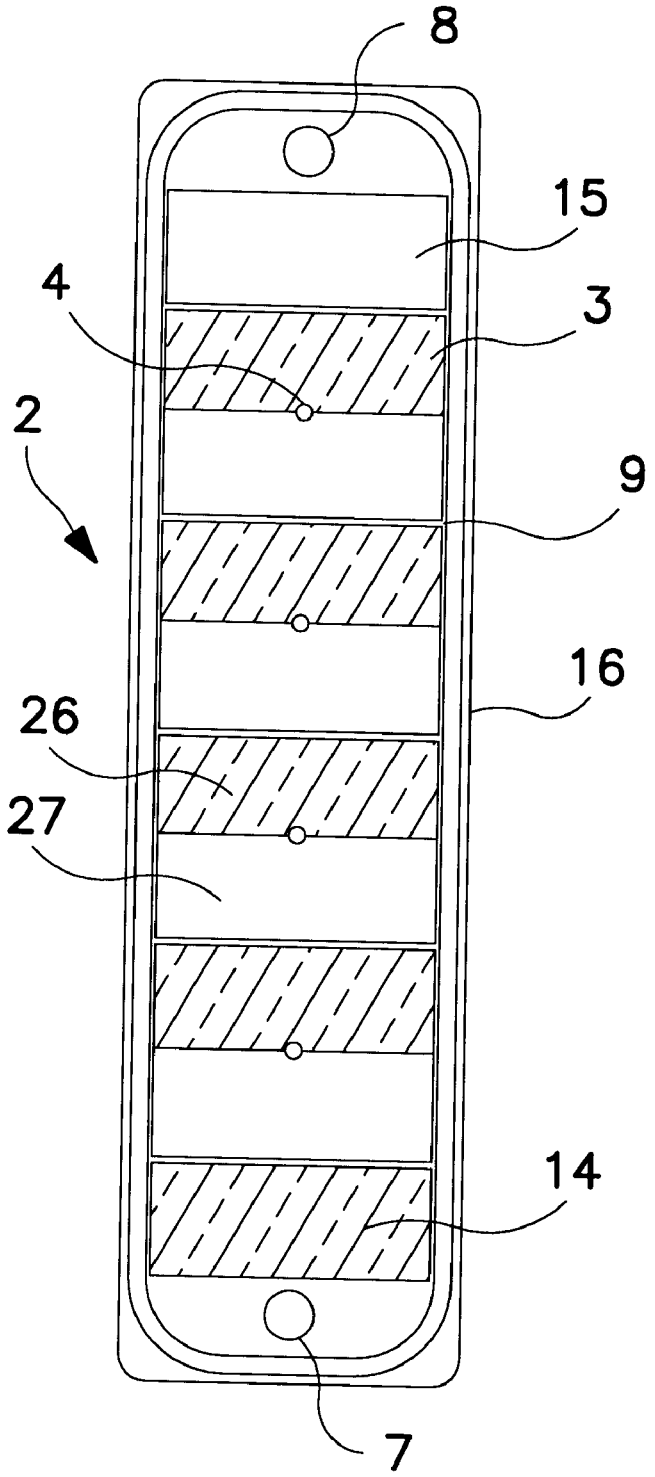
FIG. 2 is a front view of the inner face of a casing member of the electrolyzer of FIG. 1, as set forth in U.S. Pat. No. 4,783,246.

In FIG. 2, an elongated casing member 2 is shown in front view. At the bottom of the casing member 2 is a lower fluid inlet 7. Above this inlet 7 is a primary anode plate 14, which may also be referred to herein as the terminal anode section 14. Above this primary anode plate 14 is a set of four bipolar electrode elements 3. These bipolar electrode elements 3, have a metal cathode face, or cathode section, 27 plus a catalytic anode face, or anode section, 26. Above the uppermost bipolar electrode element 3 is a primary cathode plate, or terminal cathode section, 15. The electrode elements 3 are separated from themselves and from the primary anode plate 14 and primary cathode plate 15 by individual casing member ribs 9. Also the individual electrode elements 3 and the primary plates 14,15, have broad back faces secured to the casing member 2 by means of non-conductive fastening elements 4 that are centrally positioned within the electrode elements 3. The electrode elements 3 and primary plates 14,15 will generally have square or rectangular broad faces and the rectangular primary plates 14,15 have a long axis that runs transverse to the longitudinal axis of the elongated casing member 2. Above the primary cathode plate 15 is an upper fluid outlet 8. Around the outside of the casing member 2 is a peripheral groove 16 for receiving a gasket member, not shown.

Figure 3:
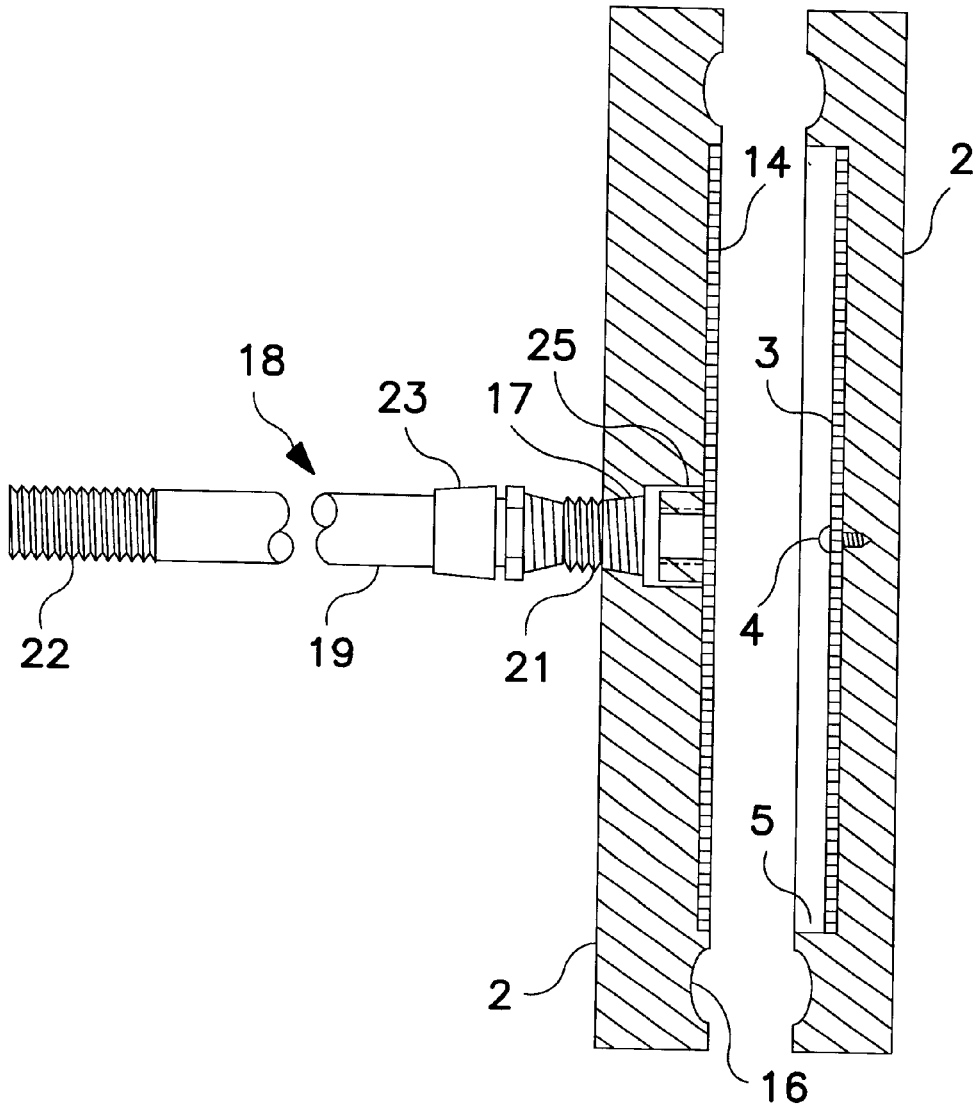
FIG. 3 is a top view of an electrolyzer casing member, as set forth in U.S. Pat. No. 4,783,246.

Referring next to FIG. 3, one casing member 2 has electrode elements 3 and the other casing member 2 has a primary anode plate 14. These electrodes 3,14 are each affixed to the casing member 2 by means of non-conductive fastening elements 4. One of the casing members 2 has an outer rim 5 that serves as a spacer. Thus upon closing of the casing members 2, the outer rim 5 presents a space, i.e., a fluid flow passageway, between the electrodes 3,14. The outer rim 5 as well as the opposite facing area of the other casing member 2 each contain a peripheral groove 16. These peripheral grooves 16 match up to form an aperture which can be filled by a gasket, not shown, upon closing of the casing members 2. In the one casing member 2 there is additionally provided a terminal connection aperture 17 whereby an electrode terminal 18 can be inserted for fastening to a lug 25 connected to a primary anode plate 14. More particularly, the electrode terminal 18 has a post 19, threaded at each end. The one set of post threads 21 can be tightened into the lug 25 which itself is fastened, e.g., welded onto the anode plate 14. The opposite threaded end 22 of the post 19 is for connection to a current lead, not shown. About the post 19, a coupling element 23 is provided for securing the electrode terminal 18 to the casing member 2.

At a minimum the electrolyzer will contain one primary anode plate 14 and one primary cathode plate 15, preferably in one casing member 2, with the opposite casing member 2 containing one bipolar electrode element 3. Advantageously for enhanced hypochlorite generation each casing member 2 will contain at least one bipolar electrode element 3 and preferably a series of such bipolar electrode elements 3 will be used in each casing member 2, e.g., 3–5 such elements 3 in each member 2. In this regard, the one casing member 2 will carry a number of bipolar electrode elements 3 as represented by "n", it then being that the opposing casing member 2 will have n−1 bipolar electrode elements, with n being a whole number including 1. Although it has been depicted in the figures that the primary anode and cathode plates 14,15 be in the same casing member 2, this need not be the case. Moreover the fluid inlet 7 and fluid outlet 8 may be in different casing members 2. Furthermore, more than one inlet 7 and outlet 8 can be utilized. It has been found that the overall structure of the inlet 7 and outlet 8, plus electrode arrangement, permits high velocity material flow across the front faces of the electrode elements 3.

The casing members 2 are preferably made of machineable or moldable plastic that is resistant to brine and which is non-conductive, e.g., they may be prepared by polyvinyl chloride. Additional suitable materials for the casing members 2 include chlorinated polyvinyl chloride, such as for high temperature operation, e.g., at brine temperatures above about 110° F., as well as such materials including glass fiber reinforced polypropylene and acrylonitrile-butadine-styrene (ABS) resins. The gaskets can be O-rings made from suitable elastomeric materials such as ethylene-propylene diene monomer (EPDM), neoprene, vinyl and other like materials which are stable in brine. Although the casing members are preferably elongated to accommodate multiple bipolar electrodes, it is contemplated that members other than elongated members can also be useful.

The electrode elements within the casing members are flat, plate-like elements. Such plates are typically on the order of about 0.1 centimeter thick and usually, for economy, will not be of a thickness exceeding about 0.65 centimeter. One broad plate face, or "back face", will be secured to a casing member by means of non-conductive fastening means, e.g., nylon screws. The opposite face, or "front face", may be elemental metal, as for the primary cathode, or partly coated to serve as a bipolar electrode, or completely coated for the primary anode. From one casing member to its opposing member, the electrode elements are offset, as shown in the Figures, whereby the current flow through the brine electrolyte can follow a staggered path. For multiple electrodes in an individual casing member, these are offset from one another, as by casing member ribs. Advantageously such spacing will not exceed about 4 centimeters, to maximize electrode area while desirably suppressing current leakage. On the other hand, a spacing of at least about one centimeter is preferred for best current leakage suppression. It is to be understood that such spacing may be adjusted in regard to the degree of salinity of the brine being electrolyzed.

The fluid flow passageway occurring between faces of electrode elements may be created by the depth of the depressions in the casing members, or by the casing member rim, or by both. Such passageway will be advantageously at least as wide as the electrode element width. For combining desirable fluid flow with efficient hypochlorite generation, the passageway thickness, or depth between electrodes, will be at least about 0.3 centimeter. On the other hand, a depth exceeding about one centimeter can lead to enhanced fluid flow, but without commensurate improvement in hypochlorite generation. Moreover, the ratio of the spacing between electrodes to the distance across the fluid flow passageway, i.e., the thickness of this passageway, will be between about 1:1 and 8:1. Advantageously, for desirable hypochlorite generation coupled with current leakage suppression, such ratio will be between about 1.5:1 and 3:1. It is to be understood that both casing members, for a member pair, may contain a rim. Conveniently when one or more rims are present, the gasketing means are present in such rims.

Advantageously for good conductivity and durability the metals of the electrode elements 3 will be one or more valve metals such as titanium, tantalum, zirconium or niobium. As well as the elemental metals themselves, the suitable metals of the electrode elements 3 can include alloys of these metals with themselves and other metals as well as their intermetallic mixtures. Of particular interest for its ruggedness, corrosion resistance and availability is titanium. A front, or "brine-facing", face of the electrode elements 3, as a whole or as a part thereof, can function as an anode with an electrochemically active coating which prevents passivation of the valve metal surface. The coating can be applied across a portion of the electrode face, e.g., on approximately a half, or on more or less than a half, of the face, such as in the manner of a stripe coating. As used herein, a coating over essentially a half or so of the bipolar electrode face is referred to for convenience as a "stripe" coating. It is also contemplated that the whole bipolar electrode face may be coated, e.g., the same coating over the whole face, or by use of a specific cathode coating adjacent a specific anode coating. In this regard it is contemplated that current reversal may at least occasionally be useful and thus assist in the cleaning of electrode surfaces.

The anodic electrochemically active coating may be provided from platinum or other platinum group metal, or it may be any of a number of active oxide coatings such as the platinum group metal oxides, magnetite, ferrite, cobalt spinel, or mixed metal oxide coatings, which have been developed for use as anode coatings in the industrial electrochemical industry. The platinum group metal or mixed metal oxides for the coating are such as have generally been described in one or more of U.S. Pat. Nos. 3,265,526, 3,632,498, 3,711,385 and 4,528,084. More particularly, such platinum group metals include platinum, palladium, rhodium, iridium and ruthenium or alloys of themselves and with other metals. Mixed metal oxides include at least one of the oxides of these platinum group metals in combination with at least one oxide of a valve metal or another non-precious metal.

For closing a pair of casing members, it is suitable that such pair be hinged together on one edge, e.g., a longitudinal edge in the manner of a book. The hinges may be conventional, with pins provided for easy removal, so as to facilitate complete removal of one casing member from the other if desired. Other fastening means found useful are buckles and hasps equipped with quick release latches which can be readily unlatched, providing tight closure during operation. Such fastening means lead to ready casing separation, i.e., opening of the "book", for cleaning and repair. Generally all such fastening fixtures, including hinges, will be metallic, e.g., steel including stainless steel, as well as bronze and plated metals as represented by chrome plated brass, although other elements, such as ceramic and plastic are contemplated.

The electrode terminals for the electrolyzer can be any of such members conventionally useful for supplying an impressed electrical current from outside a casing member to an internal primary electrode. Particularly useful are posts of a metal such as titanium, brass or titanium clad copper, which posts are mounted through the casing wall and contact the back face of the electrode, i.e., the face in contact with the casing member. Such contact may be a simple pressure contact, but will more usually involve metallurgical bonding. One preferred terminal assembly comprises a metal post which can be threadedly engaged to a lug, with the lug being welded to the electrode back face.

The following example shows a way in which an embodiment can be practiced. This example should not be construed as a limitation on the invention.

EXAMPLE

Two pieces of polyvinyl chloride (PVC) sheet approximately one inch (2.5 cm) thick, 22 inches (55.9 cm.) wide and 48 inches (121.9 cm.) long served as casing members. They are each machined to provide shallow depressions for inserting electrode elements. These depressions are one-quarter inch (0.6 cm.) deep and were each separated by one-quarter inch (0.6 cm.) PVC ribs retained in the casing during machining. The total of the electrode dimension area, but including rib space, is 20 inches (50.8 cm.) wide by 40 inches (101.6 cm.) long. The casing member as represented by FIG. 2 has a primary anode plate of electrolytically coated titanium. The electrocatalyst used is a mixed metal oxide electrocatalytic coating. The primary cathode plate is an uncoated titanium sheet. The four bipolar plates for the FIG. 2 casing member, as well as the five bipolar plates for the additional casing member are all titanium plates, each of which has half the height of the plate stripe coated with the above-described electrocatalytic coating. All electrodes are securely fastened to the PVC casing member by nylon screws which were placed centrally of each electrode plate. The titanium plates have thickness of 0.15 centimeter. Each electrode is separated from its next adjacent electrode by a one-half inch (1.27 cm.) casing member rib. The ribs are provided in the casing member during the machining thereof.

The casing members are secured together by metal hasps. A neoprene O-ring gasket is used to seal around the periphery of the casing members. One casing member has a 0.9525 centimeter deep rim, thereby providing, upon closing of the casing member pair, a fluid passageway that is 0.635 centimeter thick from electrode front face to opposite electrode front face, as well as 20 inches (50.8 cm.) wide. Exterior fluid inlet and outlet connections are provided as well as electrically conductive terminals, in the manner as shown in the Figures. Under test operation, a DC current is pressed upon the electrolyzer at a current rate of 50 Amperes. For test purposes a two percent (2%) concentration brine solution was passed through the electrolyzer at a flow rate of 5 gallons (18.9 liters) per minute and a temperature of 68° F.

(20° C.). The brine solution enters the electrolyzer bottom and flows upwardly, the electrolyzer being oriented with vertical elongation. Under continuing operation at these conditions, a sodium hypochlorite with a total chlorine concentration of 561 milligrams per liter is generated. Under such operation, ten feet of head pressure is readily withstood without electrolyzer leakage.

Figure 4:
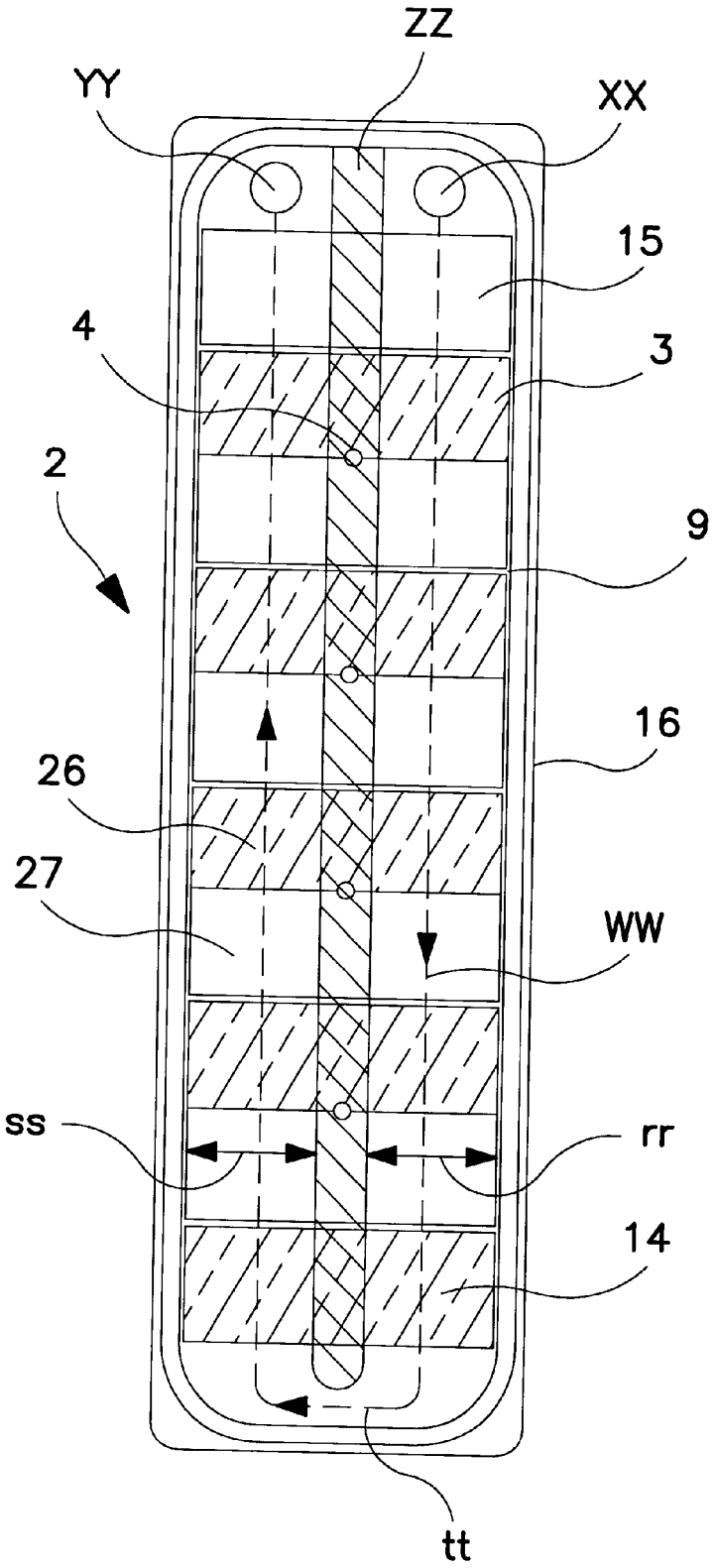
FIG. 4 is a front, cross-sectional view of an electrolyzer having two casing members, which illustrates the flow of fluid therethrough, in accordance with a first embodiment.

The electrolyzer discussed above may be enhanced by the inclusion of a divider in the fluid flow passageway. An exemplary embodiment including that improvement is illustrated in FIG. 4. That electrolyzer has two casing members 2. As illustrated in FIG. 4, a divider zz is disposed in the fluid flow passageway 11. Inclusion of the divider zz separates a passageway into two sections: section rr to one side of the divider zz and section ss to the other side of the divider. Aperture xx and aperture yy are provided at the top of section rr and section ss, respectively. Aperture xx and aperture yy may each alternatively function as either an inlet or an outlet. A crossing tt is provided between section rr and section ss such that fluid can flow between those sections. It should be appreciated that aperture xx or aperture yy may be provided in one casing member while the other aperture may be provided in another casing member, or both apertures xx and yy may be provided in the same casing member.

The following example demonstrates operations associated with the first exemplary embodiment. In this example, aperture xx is initially used as an inlet and aperture yy is initially used as an outlet. Fluid is introduced into aperture xx. After introduction, fluid travels in the direction identified by arrow ww. Specifically, it first travels through section rr of the passageway past primary cathode plate 15, other electrode elements 3, and primary anode plate 14. Crossing tt allows for the fluid to then travel to the other side of divider zz. Thereafter, the fluid travels through section ss of the passageway past primary anode plate 14, other electrode elements 3, and primary cathode plate 15. It may then egress through aperture yy. At a later time, the flow of fluid may be reversed such that it travels in the reverse direction indicated by arrow ww (where aperture yy and aperture xx function as an inlet and an outlet, respectively).

Accordingly, two "passes" are made in accordance with this exemplary embodiment.

Figure 5A:
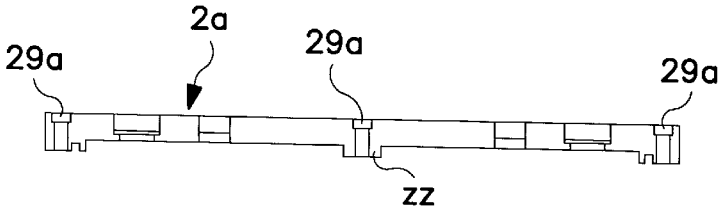
FIGS. 5–5A are front and cross-sectional views of a first casing member of an electrolyzer having two casing members, in accordance with a first embodiment.
Figure 5:
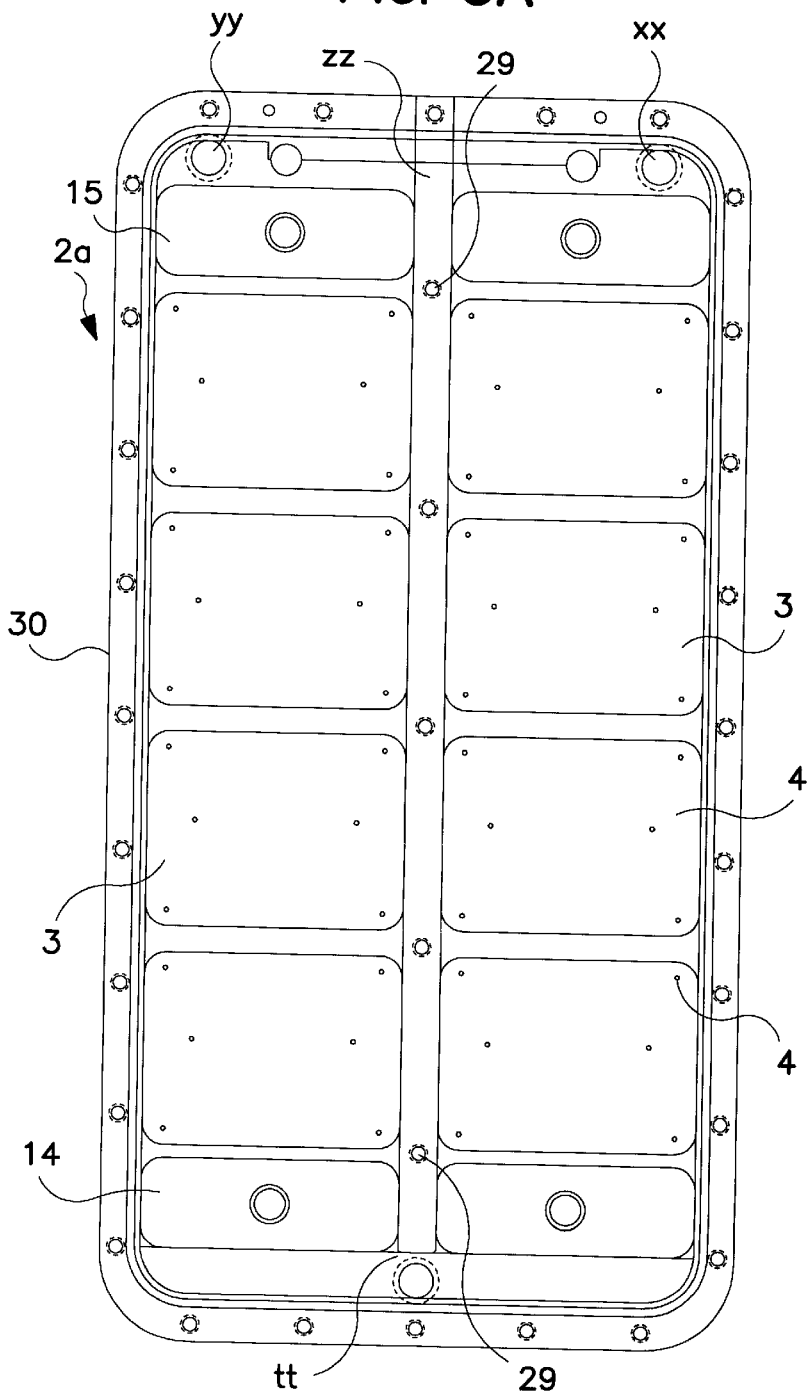
Figure 6:
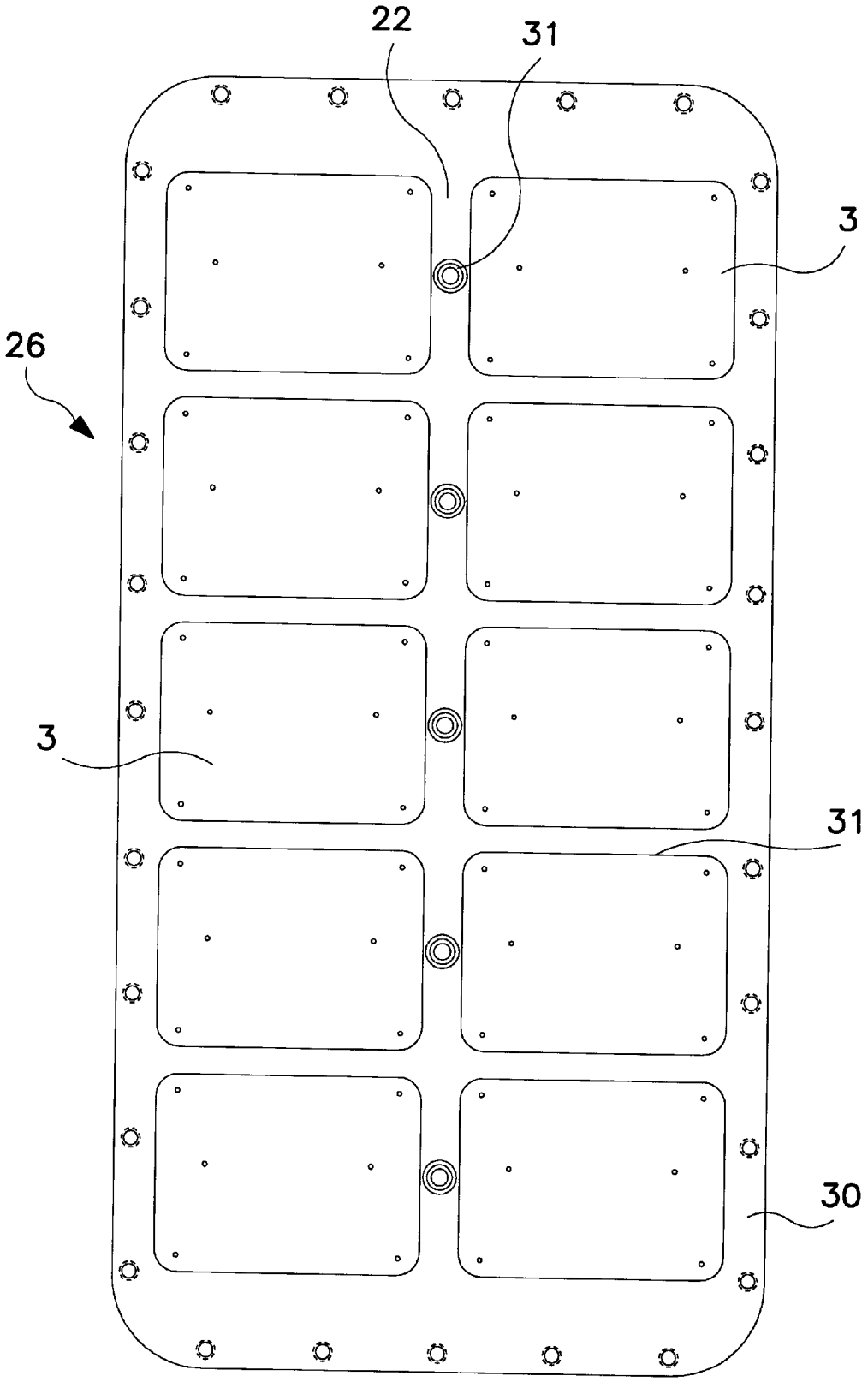
FIG. 6 is a front view of a second casing member of an electrolyzer having two casing members, in accordance with a first embodiment.

FIGS. 5–6 provide a more detailed mechanical representation of an embodiment similar to that shown and described with respect to FIG. 4. In this embodiment, two casings, referred to by reference numerals 2*a* and 2*b*, are provided. Both casings 2*a* & 2*b* include a rim 30 about their outer perimeters. A divider zz is provided in casing 2*a*, which connects to the rim between the inlet xx and the outlet yy. In this manner, the divider zz provides for flow through the passageway with two passes past the electrodes. One electrode in the embodiment would be provided in the casing to shown in FIG. 5, while another electrode would be provided in the casing 2, shown in FIG. 6. In this embodiment, the casings 2*a* & 2*b* are attached to each other such that is the passageway is contained within the two casings 2*a* & 2*b*.

The fluid would enter at aperture xx, proceed along the divider zz—along the long direction of the casing to the opening tt at which point the fluid would reverse its course through the natural fluid pressure and proceed to the aperture yy where the fluid would exit from the system. Apertures xx and yy are preferably reversible such that the fluid flow could proceed either from xx to yy through the opening tt, or from yy to xx through the opening tt.

The outer rim 30 of the casing 2*a* (shown in FIG. 5A) mates with the outer rim of the casing 2*b* (shown in FIG. 6). As can be seen from FIG. 5A, the outer rim is mated relative to the fluid cavities so as to allow space between the casings for the fluid to flow. At the center, the divider zz is arranged also to mate with a divider zz on the opposing casing or to a flat or grooved surface on the opposite casing. Thus, the only cavity in which fluid can flow through the mated casings is defined by the spaces between the outer rim and the divider zz and through the opening tt, where the divider zz does not meet the outer rim 30.

A number of mounting holes 29*a* are provided by which the casings 2*a* & 2*b* can be securely mated together. Preferably, such mating is accomplished by a number of mechanical bolts 29. However, a number of other mountings needs to be employed such as adhesives, welding, clamping, and the like. The casing 2*b* is preferably provided with bolt rings 31 to facilitate connection to the casing 2*a* via the bolts 29 and mounting holes 29*a*.

A second exemplary embodiment involves an electrolyzer having more than two casing members. That exemplary embodiment is illustrated in FIGS. 7–10. Those drawings illustrate an electrolyzer having three casing members: a door casing member 32, a middle casing member 34, and a base casing member 36. One passageway is provided between the base casing member and one side of the middle casing member. A second passageway is provided between the other side of the middle casing member and the door casing member. A divider may be interposed in each such passageway.

Figure 7:
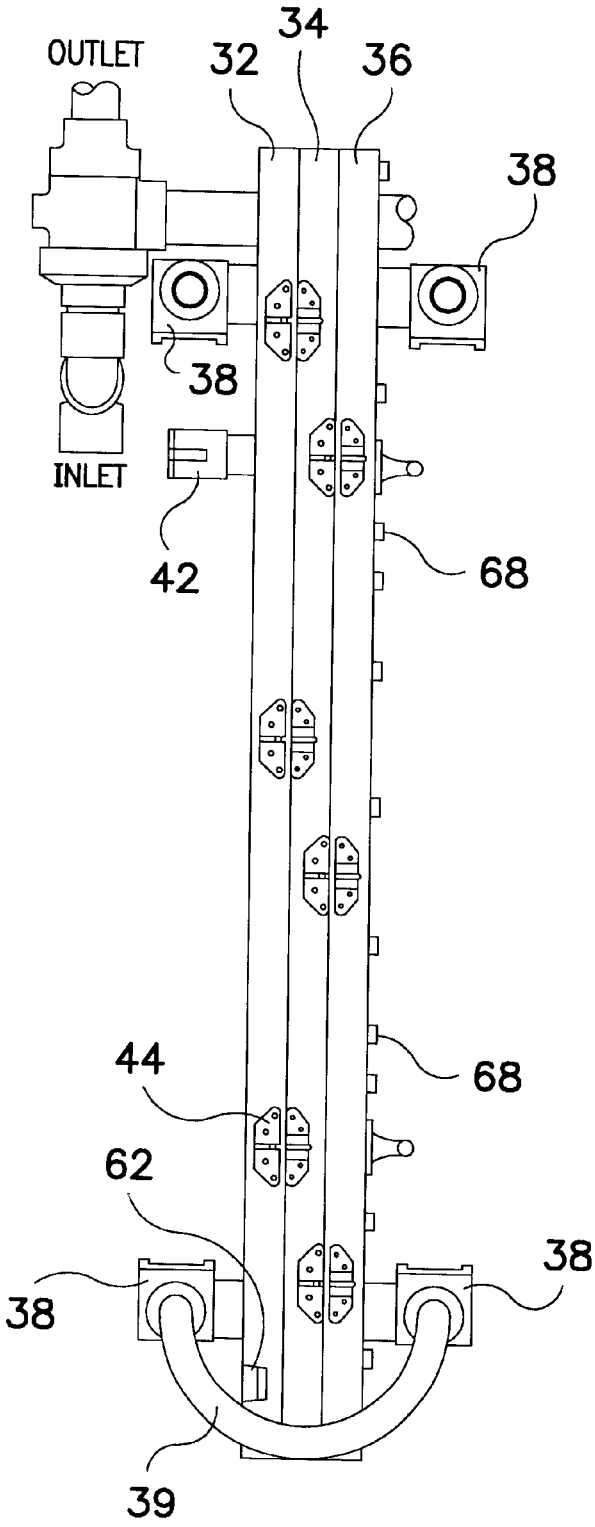
FIG. 7 is a side view of an electrolyzer having three casing members, in accordance with a second embodiment.

FIG. 7 illustrates an embodiment where three casing members—specifically, door casing 32, middle casing 34 and base casing 36—are used to form more than one passageway through which fluid may flow. In this embodiment, the inlet and outlet (see FIG. 8) are in the same short end of the rectangular casing. Electrical connections 38 are provided to connect the opposite polarity voltages to the anode and cathode plates of the electrolyzer. The electrical contacts 50 are shown in the figures to illustrate where the electrical connection is made to the primary electrodes. Also provided in this embodiment is an inlet and outlet assembly to facilitate connections of the fluid input and output to the inlet and outlet of the fluid passageway.

In this embodiment, the three casing members are preferably provided to circulate the solution to the electrolyte for more than two passes across or through the electrodes. The electrodes are preferably mounted to the casings by screws 56 or by other attachment means.

Thus, for example, the fluid may proceed down and then back up the base side of the middle casing and then proceed down and then up the door side of the middle casing, for a total of four passes between the electrodes of the electrolyzer. Also shown in this embodiment is a temperature switch assembly 42 for monitoring the temperatures within the electrolyzer, as well as drains 62. Where necessary, flexible electrical tubing 39 is provided for electrical connections between the three casings 32, 34, 36.

A number of mounting holes 66 are provided by which the casings can be securely mated together. Preferably, such mating is accomplished by a number of mechanical bolts 68. However, a number of other mountings needs to be employed such as adhesives, welding, clamping, and the like. The middle casing 34 is preferably provided with bolt rings 64 to facilitate connection to the door casing 32 and base casing 36 via the bolts 68 and mounting holes 66.

Figure 8:
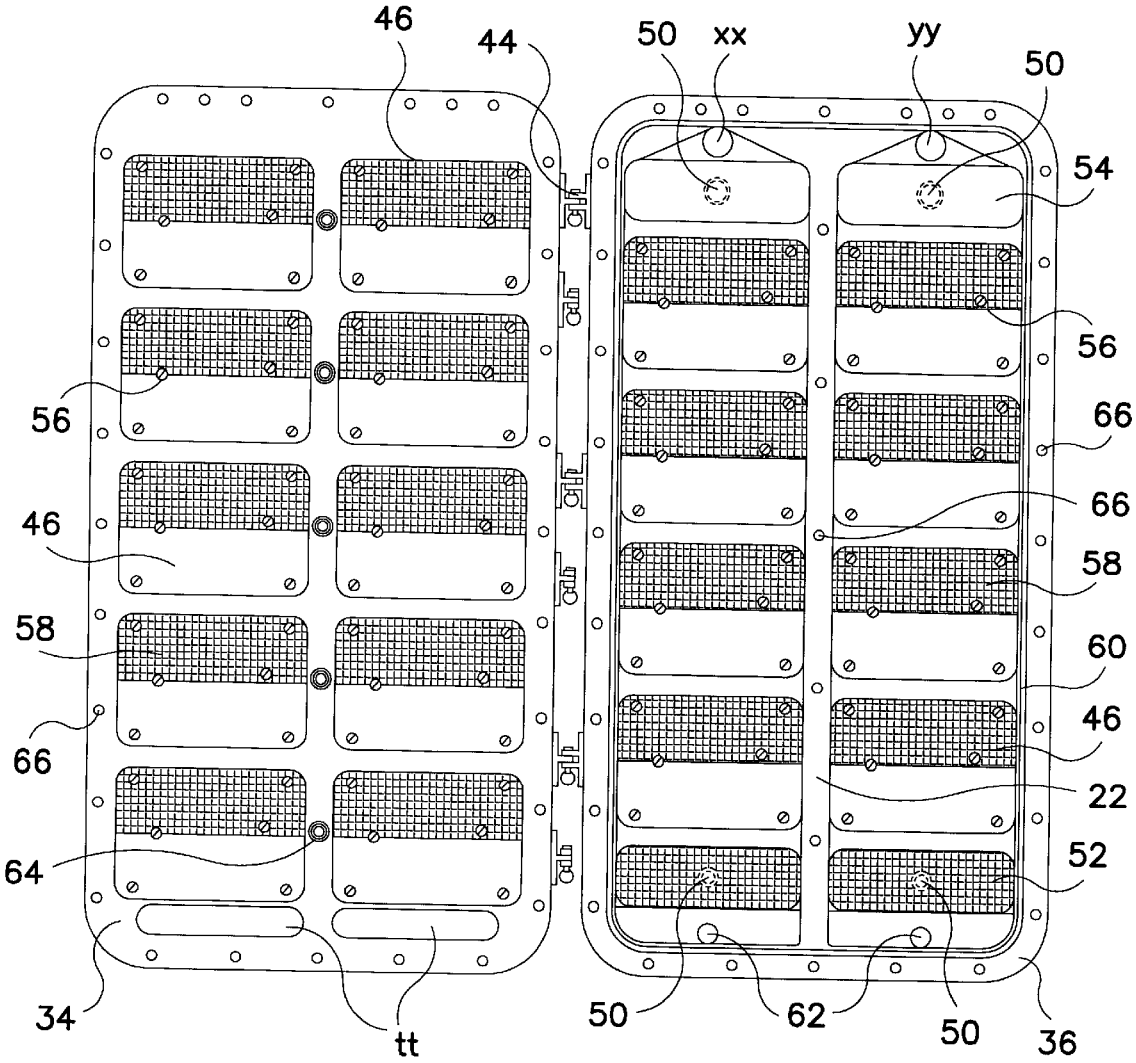
FIG. 8 is a front view of a first and second casing members of an electrolyzer having three casing members, in accordance with a second embodiment.
Figure 9:
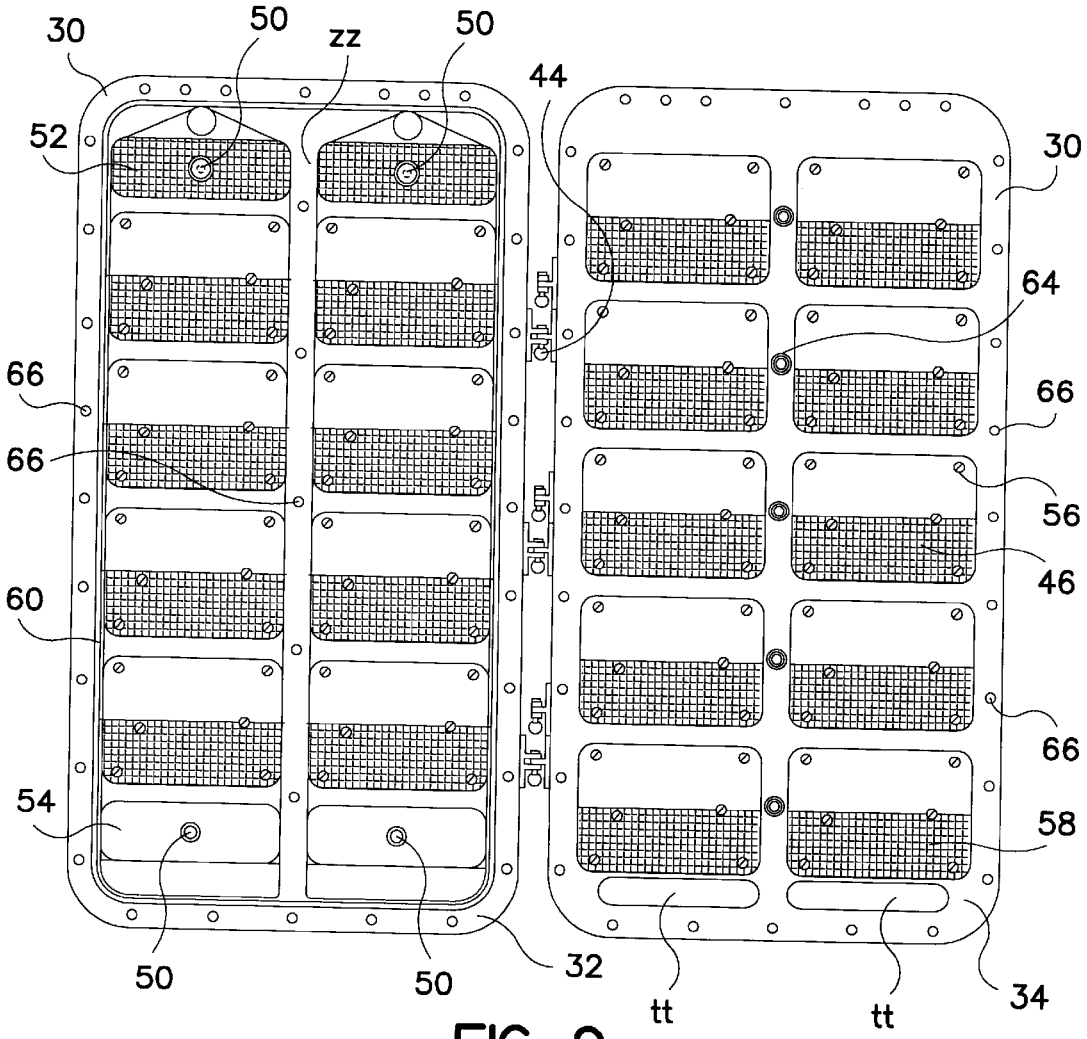
FIG. 9 is a front view of a second and third casing members of an electrolyzer having three casing members, in accordance with a second embodiment.

FIGS. 8–9 provide an internal view of an embodiment of the three casing approach, shown and described with respect to FIG. 7. The inlet and outlet xx, yy are shown in the upper right-hand side of the base casing 34.

In this embodiment, the base casing 36 and middle casing 34 are shown as connecting to each other with hinges 44. The base and middle casings connect to each other at rim 30. The fluid passageway is effectively sealed off by a groove 60 on the base and door casings. The groove 60 mates with a corresponding ridge on the middle casing.

In this embodiment, the anodes and cathodes are alternating in polarity relative to the fluid passageway. In other words, at one section of the fluid passageway, the anode is at the top of the passageway and the cathode is beneath it, but in the sections of the fluid passageway adjacent to the first section, the cathode would be at the top and the anode at the bottom, and so on.

Thus, for example, if the fluid enters the fluid passageway at inlet xx, it first passes through a cathode/anode pair where the primary cathode 54 lies in the base opposite from the anode half of a bipolar electrode plate 46 in the middle casing 36. Fluids in the passageway would then cross the anode half of another bipolar plate 46, which is in the base casing 32. The fluid would then continue on in this pattern crossing anodes/cathode pairs of opposite polarity until reaching the bottom of the figure at which time it would pass through the opening tt and would pass from the base side of the middle casing 34 to the door side of the middle casing. Bipolar plates 46 may include a coated area 58, as discussed above.

The fluid will then pass up the fluid passageway defined by the outer rim 30 of the middle casing mated to the outer rim 30 of the door casing and the divider zz located in the middle of the fluid passageway between the middle casing 34 and the door casing 36. As before, the fluid would pass over alternating anode/cathode pairs defined by primary electrodes (primary anodes 52 at the bottom and primary cathodes 54 at the top) and bipolar electrode plates 46. Upon reaching the top of the fluid passageway, defined between the middle and door casings, the fluid would then be reversed to travel along the other side of the divider zz in this casing pair. The fluid would continue to the bottom of the casing pair and pass again back through the middle casing to the base side of the middle casing 34, whereupon it will travel up the divided half of the fluid passageway in this casing pair to the outlet yy. In this embodiment, then, the fluid would have passed eventually four times through the electrolyzer cavities.

Figure 10:
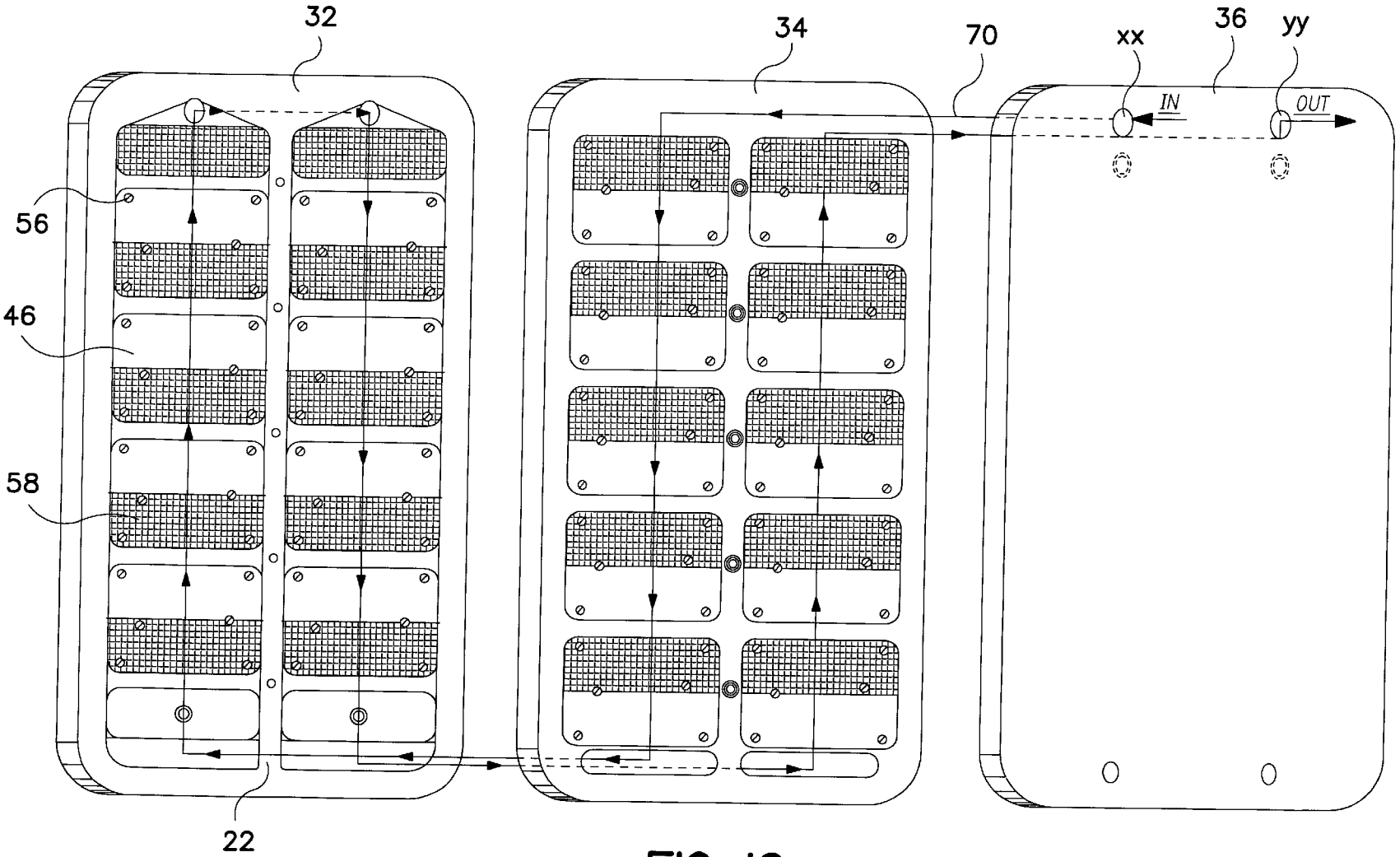
FIG. 10 is a front view of an electrolyzer having three casing members, which illustrates the flow of fluid therethrough, in accordance with a second embodiment.

FIG. 10 illustrates the flow 70 just described with respect to the casing members of FIGS. 8–9. There could be other ways of accomplishing the same multiple task solution flow through the electrolizer, for instance, the fluid could have passed up and down on the base side of the middle casing before passing to the door side of the middle casing where it could make another round trip up and down. The flow 70 could be reversed to go in through the outlet and out through the inlet. A fluid inlet could be provided with one on the door and one on the base. The fluid flow could be designed to operate with an inlet at the top of one of the door or base casings and one at the bottom of either the door or base casings. Rather than using multiple alternating polarity anode cathode pairs, large anode and cathode plates could be provided where the polarity orientation could essentially be the same throughout the entire passageway.

As can be seen from FIG. 10, fluid initially enters an aperture in the base casing member. It then travels through a first divided section of the passageway from top to bottom). However, in the absence of a crossing and the presence of an aperture at the bottom of that first divided section of the passageway that leads to the second divided section in the passageway, the fluid passes to that divided section. The fluid then travels through a first divided section of the passageway Y (from bottom to top), through a crossing, and then through a second divided section of the passageway (from top to bottom). An aperture at the bottom of the second divided section of the passageway leads to the second divided section of the passageway. Fluid then passes to, and travels through, the second divided section of the passageway (from bottom to top). Finally, the fluid leaves the passageway via another aperture in the base casing member.

Accordingly, four "passes" are made in accordance with the second exemplary embodiment.

While the improvement has been described with reference to two exemplary embodiments, this description is not intended to be construed in a limiting sense. Various modifications and combinations of the exemplary embodiments, as well as other embodiments of the improvement, should be apparent to persons skilled in the art upon reference to the description. It is therefore intended that the improvement not be limited to the described exemplary embodiments and instead encompass any such modifications or other embodiments.

What is claimed is:

1. An electrolyzer, comprising:

a housing having an inlet and an outlet;

a fluid flow passageway in the housing, the fluid flow passageway connecting to at least the inlet and the outlet;

an impermeable divider disposed in the fluid flow passageway and defining at least two sections in the fluid flow passageway, which are connected by one or more openings, wherein each of said openings are within the periphery of the housing, the divider being positioned such that at least some of the fluid entering the fluid flow passageway through the inlet and exiting through the outlet flows through each of the at least two sections of the fluid flow passageway; and first and second electrodes positioned such that application of an electrical potential across such electrodes causes field lines to pass through the at least two sections of the fluid flow passageway.

2. The electrolyzer of claim 1 wherein the first and second electrodes are each formed as single contiguous electrode.

3. The electrolyzer of claim 1 wherein the first and second electrodes are each a composite of electrically-connected smaller electrode elements.

4. The electrolyzer of claim 1, wherein the housing comprises more than one casing members having inner shallow depressions, with the members, upon closing together, providing a shallow, inner compartment.

5. The electrolyzer of claim 1, wherein the housing contains at least one bipolar electrode.

6. The electrolyzer of claim 1, wherein the housing comprises a non-conductive material.

7. An electrolyzer for producing hypochlorite by the electrolysis of brine, comprising:

a generally flat casing member which closes together at its periphery with a pivotally connected second casing member to form an electrolysis compartment between the casing members;

a terminal anode and a terminal cathode on the inside face of the flat casing member;

at least one flat bipolar electrode having an anode section and a cathode section on the inside face of the flat casing member and spaced between the terminal anode and terminal cathode;

a connection connecting the terminal anode section and the terminal cathode section of the flat casing member to an external currently supply;

an inlet and outlet for introducing electrolyte into and removing electrolyte and the product of electrolysis from the electrolysis compartment; and an impermeable divider disposed between the inlet and outlet and dividing the electrolysis compartment into at least two sections that are connected through an opening, the divider being positioned such that at least some of the fluid entering the inlet and exiting through the outlet flows through each of the at least two sections of the electrolysis compartment.

8. An electrolyzer, comprising:

a first outer casing;

a middle casing, mounted to the first outer casing and forming a first fluid flow passageway between the first outer casing and the middle casing, the first fluid flow passageway connecting at least a first inlet and a first outlet;

an impermeable first divider located in the first fluid flow passageway and defining at least two sections in the first fluid flow passageway, which are connected by one or more openings within the periphery of the middle casing, the first divider being positioned such that at least some of the fluid entering the first fluid flow passageway through the first inlet and exiting through the first outlet flows through each of the at least two sections of the first fluid flow passageway;

a second outer casing mounted to the middle casing and forming a second fluid flow passageway between the middle casing and the second outer casing, the second fluid flow passageway connecting at least a second inlet and a second outlet;

an impermeable second divider located in the second fluid flow passageway and defining at least two sections in the second fluid flow passageway, which are a connected by one or more openings within the periphery of the middle casing, the second divider being positioned such that at least some of the fluid entering the second fluid flow passageway through the second inlet and exiting through the second outlet flows through each of the at least two sections of the second fluid flow passageway;

first and second electrodes positioned such that application of an electrical potential across such electrodes causes field lines to pass through the at least two sections of the second fluid flow passageway; and third and fourth electrodes positioned such that application of an electrical potential across the third and fourth electrodes causes field lines to pass through the at least two sections of the second fluid passageway.

9. The electrolyzer of claim 8 wherein the first and third electrodes are electrically connected.

10. The electrolyzer of claim 8 wherein the second and fourth electrodes are electrically connected.

11. The electrolyzer of claim 8 wherein the first and third electrodes are electrically connected and the second and fourth electrodes are electrically connected and wherein the electrodes are positioned such that application of an electrical potential between the first/third electrode set and the second/fourth electrode set cause field lines to pass through the first and second sections of the first fluid flow passageway and the first and second sections of the second fluid flow passageway.

12. The electrolyzer of claim 11 wherein the first/third electrode set and the second/fourth electrode set are each formed as single contiguous electrodes.

13. The electrolyzer of claim 11 wherein the first/third electrode set and the second/fourth electrode set are each a composite of electrically-connected smaller electrode elements.

14. A method of producing electrolysis product, wherein liquid electrolyte flows within a housing containing at least one electrode, comprising:

providing an inlet for introducing electrolyte into the housing, an outlet for removing electrolyte from the housing, and a passageway permitting the flow of fluid between the inlet and outlet;

interposing an impermeable divider between the inlet and outlet so as to divide the passageway into at least two sections connected by an opening within the periphery of the housing; and feeding liquid electrolyte to the housing through the inlet on either side of the divider for flowing into contact with at least one electrode housed in the passageway such that the liquid electrolyte flows through each of the at least two sections.

15. The method of claim 14 wherein the housing comprises more than one casing members which close together to provide therebetween a shallow, inner electrolysis compartment.

* * * * *